US006249077B1

(12) United States Patent
Brown et al.

(10) Patent No.: US 6,249,077 B1
(45) Date of Patent: Jun. 19, 2001

(54) ARC TUBE, MOUNTING MEMBER AND ELECTRIC LAMP ASSEMBLY

(75) Inventors: Randall D. Brown, Barrington; Joseph C. Swadel, Salem, both of NH (US); Edward H. Nortrup, Stoneham, MA (US); Simone P. Bazin, Bedford, NH (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 09/260,254

(22) Filed: Mar. 2, 1999

(51) Int. Cl.[7] ..... H01J 17/28
(52) U.S. Cl. ..... 313/25; 313/11; 313/17
(58) Field of Search ..... 313/25, 569, 574, 313/632, 631, 39, 578, 318; 315/344

(56) References Cited

U.S. PATENT DOCUMENTS 5,136,204 * 8/1992 Muzeroll et al. ..... 313/25
5,142,195 * 8/1992 Heider et al. ..... 313/623
5,252,885 10/1993 Muzeroll et al. ..... 313/25
5,323,091 * 6/1994 Morris ..... 315/344
5,677,589 * 10/1997 Westemeyer ..... 313/318.07

FOREIGN PATENT DOCUMENTS 0596735 5/1994 (EP) ..... H01J/61/54

* cited by examiner

*Primary Examiner*—Vip Patel
*Assistant Examiner*—Ken A Berck
(74) *Attorney, Agent, or Firm*—William H. McNeill

(57) ABSTRACT

A mounting member for supporting a shroud, and an arc tube located within such shroud, in an arc discharge lamp is provided. The mounting member includes at least two support clips welded to at least one support rod on the same side of the support rod. A bubble-in-the-press arc lamp is provided having at least one press seal that includes opposite walls. A bubble portion is formed in one wall, and the other wall includes a protrusion. The bubble portion extends towards one wall and the protrusion extends towards the other wall to hold a support clip of a supporting member therebetween. An electric lamp assembly is provided that includes the mounting means and/or the bubble-in-the-press arc tube of the present invention.

21 Claims, 3 Drawing Sheets

ARC TUBE, MOUNTING MEMBER AND ELECTRIC LAMP ASSEMBLY

TECHNICAL FIELD

This invention relates to a mounting member for supporting a shroud, and an arc tube located within the shroud, within a lamp such as a metal halide arc discharge lamp. This invention also relates to a bubble-in-the press arc tube. An electric lamp assembly containing such a mounting member and/or such a bubble-in-the-press arc tube is also provided.

BACKGROUND ART

Metal halide arc discharge lamps are frequently employed in commercial usage because of their high luminous efficacy and long life. A typical metal halide arc discharge lamp includes a quartz or fused silica arc tube that is hermetically sealed within a borosilicate glass outer envelope. The arc tube, itself hermetically sealed, has tungsten electrodes sealed into opposite ends and contains a fill material including mercury, metal halide additives and a rare gas to facilitate starting. In some cases, particularly in high wattage lamps, the outer envelope is filled with nitrogen or another inert gas at less than atmospheric pressure. In other cases, particularly in low wattage lamps, the outer envelope is evacuated.

It has been found desirable to provide metal halide arc discharge lamps with a shroud that comprises a generally cylindrical, light-transmissive member, such as quartz, that is able to withstand high operating temperatures. The arc tube and the shroud are coaxially mounted within the lamp envelope with the arc tube located within the shroud. Preferably, the shroud is a tube that is open at both ends. In other cases, the shroud is open on one end and has a domed configuration on the other end. Shrouds for metal halide arc discharge lamps are disclosed in U.S. Pat. No. 4,499,396 issued Feb. 12, 1985 to Fohl et al. and U.S. Pat. No. 4,580,989 issued Apr. 8, 1986 to Fohl et al. See also U.S. Pat. No. 4,281,274 issued Jul. 28, 1981 to Bechard et al.

The shroud has several beneficial effects on lamp operation. In lamps with a gas-filled outer envelope, the shroud reduces convective heat losses from the arc tube and thereby improves the luminous output and the color temperature of the lamp. In lamps with an evacuated outer envelope, the shroud helps to equalize the temperature of the arc tube. In addition, the shroud effectively reduces sodium losses and improves the maintenance of phosphor efficiency in metal halide lamps having a phosphor coating on the inside surface of the outer envelope. Finally, the shroud improves the safety of the lamp by acting as a containment device in the event that the arc tube shatters.

It is known to provide a metal halide arc discharge lamp having an arc tube that includes an ultraviolet starting aid. U.S. Pat. No. 5,323,091 issued Jun. 21, 1994 to Morris illustrates examples of such arc tubes. The arc tubes described in this patent are known in the art as bubble-in-the-press arc tubes and include a starting aid that is formed in a cavity in a press seal portion of the arc tube. An electrode is provided in the cavity that may extend external to the press seal or be a portion of a molybdenum ribbon used in the press seal.

Although prior art bubble-in-the-press arc tube configurations provide generally satisfactory performance, they have been found to have certain disadvantages particularly regarding the mounting thereof within the shroud of the arc discharge lamp. For example, in a typical metal halide arc discharge lamp that includes a bubble-in-the-press arc tube, it is desired to center the arc tube, the shroud and the shroud holder in the lamp outer envelope. However, heretofore, there has been a tendency for the bubble-in-the-press seal of the arc tube to offset the arc tube within the shroud; that is, the arc tube has tended to be mounted off-center relative to the longitudinal axis of the shroud.

Mounting of the shroud has also incurred disadvantages. In the aforementioned U.S. Pat. No. 4,580,989, two techniques for mounting the shroud are disclosed. According to one technique, the shroud is retained by two metal straps that encircle the shroud and are welded to a frame. According to the second mounting technique, the open end of the shroud is provided with a pair of diametrically opposite slots. The slots engage a metal strap used for mounting of the arc tube.

While both prior art configurations provide generally satisfactory performance, they have been found to have certain disadvantages, particularly in a high volume production environment. In the construction that utilizes a pair of straps that encircle the shroud, the shroud tends to shift lengthwise and/or rotate in the straps when the lamp is jarred during shipping or handling. In the construction that utilizes a pair of slots for engaging a lamp mounting strap, the shroud is subject to cracking or breakage in the areas of the slots where the shroud contacts the strap. Furthermore, it is necessary to heat treat the shroud in the region of the slots to reduce the possibility of cracking or breakage. The heat treatment step adds to the production cost. Accordingly, it is desirable to provide a metal halide arc discharge lamp wherein the shroud is securely locked in position, while cracking or breakage of the shroud is avoided.

U.S. Pat. No. 5,252,885 issued Oct. 12, 1993 to Muzeroll et al. illustrates an electric lamp assembly designed to overcome the foregoing concerns. Such electric lamp assembly includes a sealed lamp envelope, a lamp capsule located within the lamp envelope, a cylindrical, light-transmissive shroud surrounding the lamp capsule, and a mounting arrangement for supporting the lamp capsule and the shroud within the lamp envelope. The mounting arrangement includes one or two support rods parallel to the axis of the shroud and first and second mounting clips for retaining the shroud and the lamp capsule. The clips prevent both axial and lateral movement of the shroud. The clips are attached to the support rods, typically by welding. In a preferred embodiment, a single clip at each end of the shroud retains both the shroud and the lamp capsule, and requires only a single weld to the support rod.

While such electric lamp assembly provides generally satisfactory performance, it has been found to have certain disadvantages in a high volume production environment. For example, in the construction of such an electric lamp assembly, the two mounting clips are welded to opposite sides of the metal support rods that are attached to the lamp stem. Processing the mounting arrangement in this manner complicates the weld process and tends to effect an imbalance in the finished product to the extent that the shroud is subjected to undesirable torque. Such imbalance is undesirable at least to the extent that when such an electric lamp assembly is inadvertently dropped there is a tendency for shroud failure due to such torque. Such failure may be in the form of movement, cracking or breakage of the shroud.

DISCLOSURE OF THE INVENTION

It is a general object of the present invention to provide improved electric lamps and, more particularly, improved arc discharge lamps.

It is a further object of the present invention to provide an electric lamp assembly wherein a light-transmissive shroud is securely locked in position.

It is yet another object of the present invention to provide an arc discharge lamp having a light-transmissive shroud that is protected against movement, cracking and breakage during shipping and handling.

It is still another object of the present invention to provide an arc discharge lamp that is low in cost and is easily manufactured.

It is a further object of the present invention to provide a mounting member that mounts a shroud and arc tube within an outer envelope of a lamp without incurring an unbalanced finished product or subjecting the shroud to unnecessary torque.

It is another object of the present invention to provide a mounting member that may be processed using a less complicated welding process.

It is yet another object of the present invention to provide a bubble-in-the-press arc tube that may be readily centered relative to a longitudinal axis of a shroud within that the arc tube is positioned.

It is another object of the present invention to provide an improved metal halide arc discharge lamp.

This invention achieves these and other objects by providing a mounting member for supporting a shroud, and an arc tube located within the shroud, within an arc discharge lamp. The mounting member comprises at least an elongated first member structured and arranged for mounting within an arc discharge lamp and having a first length, the first length extending in a plane. A first support clip is welded to the first length at a first weld portion, and a second support clip is welded to the first length at a second weld portion spaced from the first weld position. The first and second support clips are structured and arranged for supporting a first press seal of an arc tube and a first end of a shroud, and an opposite second press seal of the arc tube and an opposite second end of the shroud, respectively. The first and second weld portions are located on the same side of the plane. An electric lamp assembly, containing such a mounting member is also provided.

A bubble-in-the-press arc tube is provided that comprises an arc tube comprising a sealed body portion and at least one press seal extending from the body portion and having a sealed bubble portion in the press seal. The press seal includes a first wall and an opposing second wall.

The second wall includes a protrusion that extends in a direction towards the first wall. The first and second walls are structured and arranged to receive therebetween a support clip. The bubble portion includes a first portion that extends in a direction away from the second wall and a second portion that extends in a direction towards the second wall. The second portion and the protrusion are structured and arranged to engage and hold a support clip in place between the first and second walls. An electric lamp assembly containing such a bubble-in-the-press arc tube is also provided.

BRIEF DESCRIPTION OF THE DRAWINGS

This invention may be clearly understood by reference to the attached drawings in that like reference numerals designate like parts and in that.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
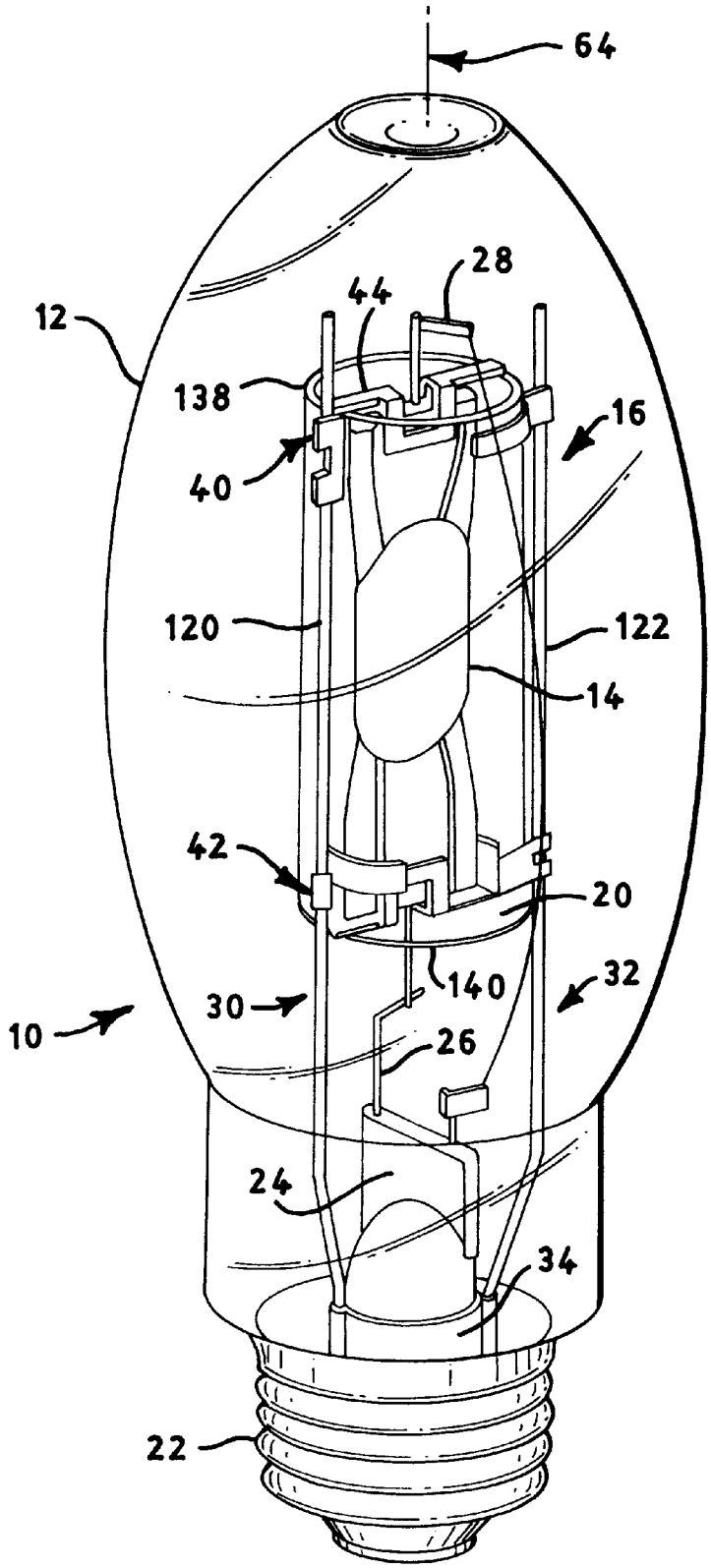
FIG. 1 is a perspective view of a lamp assembly in accordance with one embodiment of the present invention.

An electric lamp assembly 10 in accordance with a preferred embodiment of the present invention is shown in FIG. 1. The lamp assembly 10 includes a sealed light-transmissive outer envelope 12 and an arc tube or lamp capsule 14 mounted within outer envelope 12 by a mounting member 16 to be described in detail hereinafter. The arc tube 14 is positioned within a shroud 20. The shroud 20 is supported in the lamp assembly 10 by the mounting member 16. Electrical energy is coupled to arc tube 14 through a base 22, a stem 24 and electrical leads 26 and 28 in a conventional manner. Outer envelope 12 is typically formed from blow-molded hard glass. The lamp capsule 14 can be a metal halide arc discharge lamp, a tungsten halogen incandescent capsule or any other lamp capsule that is advantageously operated with a shroud. The shroud 20 comprises a cylindrical tube of light-transmissive, heat-resistant material such as quartz. In the embodiment illustrated in FIG. 1, the arc tube 14 is a bubble-in-the-press arc tube wherein an ultraviolet starting aid is provided by forming a cavity in one or more press seal portion, an electrode being provided in such cavity. Some examples of bubble-in-the-press arc tubes are illustrated in said U.S. Pat. No. 5,323,091. This patent is commonly owned with the instant application (GTE Products Corporation having changed its name to Osram Sylvania Inc.), and is incorporated herein by reference. The bubble-in-the-press tube 14 is an improvement of the arc tube with ultraviolet starting aid illustrated in U.S. Pat. No. 5,323,091.

The mounting member 16 mechanically supports both the lamp capsule 14 and the shroud 20 within l amp envelope 12. The mounting member 16 secures lamp capsule 14 and shroud 20 in fixed positions so that they cannot move axially or laterally relative to the remainder of the assembly during shipping and handling or during operation. Although the mounting member 16 is illustrated in use with a bubble-in-the-press arc tube 14, such mounting member may also be used with a conventional arc tube not having a bubble-in-the-press, if desired. The mounting member 16 includes spaced apart members such as metal support rods 30 and 32 attached to stem 24 by a strap 34 in a conventional manner. The arc tube and shroud supporting portions of support rods 30 and 32 are parallel to a central axis of lamp capsule 14 and shroud 20. The mounting member 16 further includes an upper clip 40 and a lower clip 42 that secure both lamp capsule 14 and shroud 20 to support rods 30 and 32.

Figure 2:
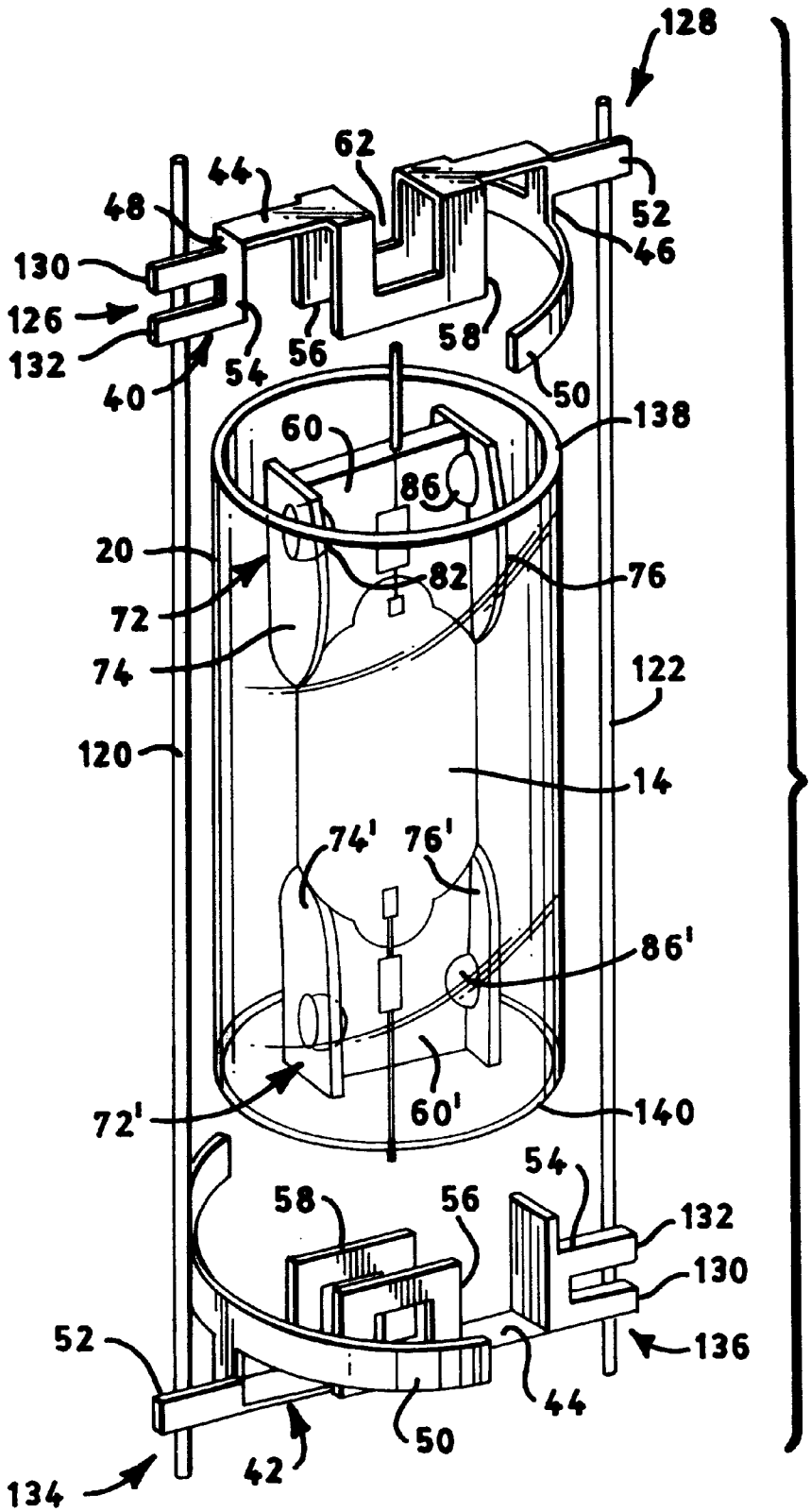
FIG. 2 is an exploded view illustrating the mounting member, arc tube and shroud of the lamp assembly of FIG. 1.

With reference to FIG. 2, each support clip 40 and 42 is formed as an integral metal element. For example, support clip 40 is formed as an integral metal element including a strap 44 having inturned ends 46 and 48. An arcuate portion 50 is affixed to inturned end 46, and tabs 52 and 54 are affixed to inturned ends 46 and 48, respectively.

The arcuate portion 50 is formed to encircle approximately half of the circumference of shroud 20. The strap 44 passes over and bears against the end of shroud 20. The spacing between inturned ends 46 and 48 is the same or slightly larger than the outside diameter of shroud 20 so that shroud 20 is retained between inturned end 46 and arcuate portion 50 on one side, and inturned end 48 on the other side.

The strap 44 is provided with spaced-apart projections 56 and 58 for retaining lamp capsule 14 between them. In the preferred embodiment, the projections 56 and 58 are generally U-shaped portions that are perpendicular to the portion of strap 44 that bears against the end of shroud 20. The projections 56 and 58 are spaced to receive a flattened press seal region 60, of lamp capsule 14. The strap 44 includes an opening 62 of sufficient size to provide clearance for the electrical lead 28 illustrated in FIG. 1.

The clips 40 and 42 are preferably identical and are formed of sheet metal having a thickness of 0.020 inch. Clips 40 and 42 are illustrated in the drawings as being rotated 180° relative to each other about the lamp longitudinal axis 64 with the clip 42 being inverted relative to clip 40 so that the projections 56, 58 of clip 42 extend towards the projections 56, 58 of clip 40, and the respective arcuate portions 50 oppose each other, one being adjacent one edge of the shroud and the other being adjacent an opposite edge of the shroud. In this manner, the clips 40 and 42 secure the lamp 14 and shroud 20 therebetween and to support rods 30 and 32. Some examples of mounting means for supporting a lamp capsule and a shroud are illustrated in said U.S. Pat. No. 5,252,885. This patent is also commonly owned with the instant application and is incorporated herein by reference. The mounting member 16 is an improvement of the mounting means illustrated in U.S. Pat. No. 5,252,885 as described hereinafter.

Figure 3:
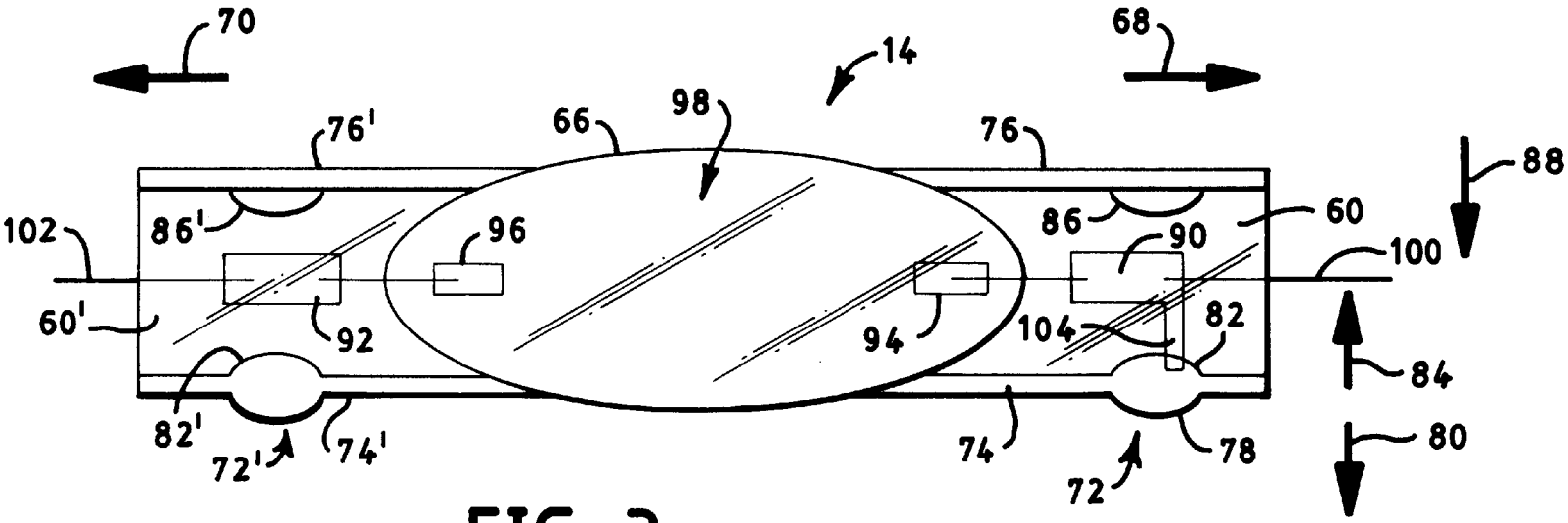
FIG. 3 is a plan view of the arc tube of FIGS. 1 and 2.
Figure 4:
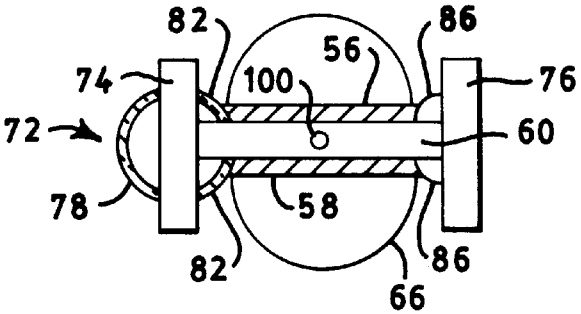
FIG. 4 is an end view of the arc tube of FIG. 3, partially sectional, from the right of the drawing.

In considering the bubble-in-the-press arc tube of the present invention, an arc tube is provided that comprises a sealed body portion and at least one press seal, that includes a sealed bubble portion, extending from such body portion. For example, in the embodiment illustrated in the drawings, an arc tube is provided having two press seals extending away from a central body portion. In particular, and with particular reference to FIGS. 3 and 4, the bubble-in-the-press arc tube 14 comprises a sealed body portion 66, a first press seal 60 extending away from the body portion in a first direction 68, and a second press seal 60' extending away from the body portion in an opposite second direction 70. The press seal 60 includes a sealed bubble portion 72. The press seal 60 includes a first wall 74 and an opposing second wall 76. In the embodiment illustrated in FIGS. 3 and 4, the sealed bubble portion 72 is provided in wall 74 and includes a first portion 78 that extends in a direction 80 away from the second wall 76 and a second portion 82 that extends in a direction 84 towards second wall 76. Wall 76 includes a protrusion 86 that extends in a direction 88 towards the first wall 74. The sealed bubble portion 72 and the protrusion 86 may be formed during the formation of the arc tube such that the bubble portions 78, 82 and the protrusion 86 extend above and below the plane of the press seal 60 as illustrated in FIG. 3. The first and second walls 74, 76 are structured and arranged to receive therebetween support clips 56 and 58 with the press seal 60 being sandwiched therebetween as illustrated in FIG. 4. It will be readily apparent from FIG. 4 that the second portion 82 of the sealed bubble portion 72 and the protrusion 82 are structured and arranged to engage and hold support clips 56, 58 in place between the walls 74 and 76. In the embodiment illustrated in FIGS. 3 and 4, the second portion 82 of the sealed bubble portion 72 and the protrusion 86 are structured and arranged to substantially center the support clips 56 and 58 between the walls 74 and 76.

In considering the embodiment illustrated in FIG. 3, the bubble-in-the-press seal 14 includes conductive foils 90 and 92 sealed in press seals 60 and 60', respectively, in a conventional manner. Electrodes 94 and 96 are electrically connected to a respective foil 90 and 92 and extend into an interior 98 of the body portion 66 in a conventional manner. Further, leads 100 and 102 are electrically connected to a respective foil 90 and 92 and extend out of press seals 60 and 60', respectively, in a conventional manner. In the embodiment illustrated in FIG. 3, foil 90 includes a segment 104 that extends into bubble portion 72.

Without limitation, in the embodiment illustrated in FIG. 3, the press seal 60' includes similar walls 74' and 76' and a similar sealed bubble portion 72' and opposing protrusion 86'. The foil 92 may include a segment similar to segment 104 extending into the bubble portion 72', if desired.

In considering the mounting member of the present invention, at least an elongated first member is provided that is structured and arranged for mounting within an arc discharge lamp. Such elongated first member includes a first length that extends in a plane. A first support clip is welded to the first length at a first weld portion, and a second support clip is welded to the first length at a second weld portion spaced from the first weld portion. The first and second support clips are structured and arranged for supporting a first press seal of an arc tube and a first end of a shroud, and an opposite second press seal of the arc tube and an opposite second end of such shroud, respectively. The first and second weld portions are located on the same side of the plane in that the first length extends.

Figure 5:
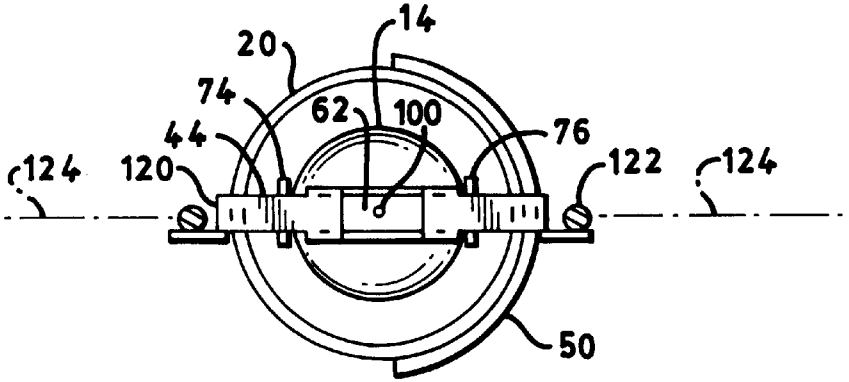
FIG. 5 is a view of the top portion of the arc tube illustrated in FIG. 1.

FIGS. 1 and 2 illustrate one embodiment of the mounting member of the present invention. As noted above, mounting member 16 is provided for supporting the shroud 20, and arc tube 14 located within the shroud, within the interior of the sealed light-transmissive lamp envelope 12 of arc discharge lamp 10. Mounting member 16 includes an elongated first member in the form of the support rod 30 that is mounted within the interior of the arc discharge tube 10 on stem 24 by strap 34. Support rod 30 includes a first length 120 that extends in the direction of axis 64. Mounting member 16 also includes an elongated second member in the form of the support rod 32 that is mounted within the interior of the arc discharge tube 10 on stem 24 by strap 34. Support rod 32 includes a second length 122 that extends in the direction of axis 64. The first and second lengths 120 and 122 are substantially parallel and extend in a plane schematically illustrated in FIG. 5 by line 124. The support clip 40 is welded to the length 120 at a weld portion 126 and to the length 122 at a weld portion 128. In particular, the tab 52 is welded to the length 122, and the two arms 130 and 132 of the tab 54 are each welded to the length 120. Similarly, the support clip 42 is welded to the length 120 at a weld portion 134 and to the length 122 at a weld portion 136, weld portions 134 and 136 being spaced from weld portions 126 and 128, respectively, in the direction of the axis 64. In particular, the tab 52 of support clip 42 is welded to the length 120, and the two arms 130 and 132 of the tab 54 of support clip 42 are welded to the length 122. The first and second support clips 40 and 42 are structured and arranged for supporting, respectively, the first press seal 60 and a first end 138 of the shroud 20, and the second press seal 60' and an opposite second end 140 of the shroud 20. With particular reference to FIGS. 2 and 5, each of the weld portions 126, 128, 134 and 136 are located on the same side of the plane 124.

As noted herein, the mounting members 40 and 42 are identical and have been rotated 180° relative to axis 64. In the embodiment illustrated in FIGS. 1 and 2, the arcuate portion 50 of the mounting member 40 is adjacent the upper weld portion 128 and the arcuate portion 50 of the mounting member 42 is adjacent the lower and opposite weld portion 134. Arcuate portions 50 of mounting members 40 and 42 are structured and arranged to encircle respective portions of the outer peripheral surface of the shroud 20 adjacent respective ends 138 and 140.

The mounting member of the present invention, such as mounting member 16, permits the mounting of a shroud and an arc tube within an outer envelope of a lamp without incurring an unbalanced finished product or subjecting the shroud to unnecessary torque. In the embodiment illustrated in FIGS. 1 and 2, these objects are accomplished by welding the support members 40, 42 to rod lengths 120 and 122 on the same side of the plane 124 in that the support rods 30 and 32 extend.

Such a welding process is less complicated than that used heretofore wherein portions of the support members are welded on opposite sides of the support rod(s) as illustrated, for example, in said U.S. Pat. No. 5,252,885.

The bubble-in-the-press arc tube of the present invention is readily centered relative to a longitudinal axis of a shroud within that the arc tube is mounted. For example, in the embodiment illustrated in the drawings, such centering is effected at press seal 60 by the extending portion 82, of the bubble portion 72, an d the protrusion 86, and at press seal 60' by the extending portion 82', of the bubble portion 72', and the protrusion 86', as described herein.

An improved arc discharge lamp may be provided that includes the mounting member and/or the bubble-in-the-press arc tube of the present invent ion. In such lamp the shroud will be securely locked in position and will be protected against movement, cracking and breakage during shipping and handling. This will be true even when a lamp or carton of lamps is inadvertently dropped. Such a lamp is low in cost and easily manufactured. The mounting member and/or bubble-in-the-press arc tube is particularly useful in a metal halide arc discharge lamp.

The embodiments that have been described herein are but some of several that utilize this invention and are set forth here by way of illustration but not of limitation. It is apparent that many other embodiments that will be readily apparent to those skilled in the art may be made without departing materially from the spirit and scope of this invention.

What is claimed is:

1. A bubble-in-the-press arc tube, comprising an arc tube comprising a sealed body portion and at least one press seal extending from said body portion and having a sealed bubble portion in said press seal, said at least one press seal including a first wall and an opposing second wall, said second wall including a protrusion that extends in a direction towards said first wall, said first and second walls being structured and arranged to receive therebetween a support clip, and said bubble portion including a first portion that extends in a direction away from said second wall and a second portion that extends in a direction towards said second wall, said second portion and said protrusion being structured and arranged to engage respective edges of said support clip to hold said support clip in place between said first and second walls.

2. The bubble-in-the-press arc tube of claim 1 comprising a first press seal extending away from said body portion in a first direction, and a second press seal extending away from said body portion in an opposite second direction, at least said first press seal comprising a sealed bubble portion.

3. The bubble-in-the-press arc tube of claim 2 further including a conductive first foil in said first press seal, a first electrode electrically connected to said first foil and extending into an interior of said body portion, and a first lead electrically connected to said first foil and extending out of said first press seal, and a conductive second foil in said second press seal, a second electrode electrically connected to said second foil and extending into said interior of said body portion, and a second lead electrically connected to said second foil and extending out of said second press seal.

4. The bubble-in-the-press arc tube of claim 3 wherein at least one of said first foil and said second foil includes a segment that extends into a bubble portion of one of said first press seal and said second press seal, respectively.

5. The bubble-in-the-press arc tube of claim 1 wherein said second portion and said protrusion are structured and arranged to substantially center a support clip between said first and second walls.

6. The bubble-in-the-press arc tube of claim 4 wherein said second portion and said protrusion are structured and arranged to substantially center a support clip between said first and second walls.

7. A mounting member for supporting a shroud, and an arc tube located within said shroud, within an arc discharge lamp, comprising:

at least an elongated first member structured and arranged for mounting within an arc discharge lamp and having a first length, said first length extending in a plane; and a first support clip welded to said first length at a first weld portion, and a second support clip welded to said first length at a second weld portion spaced from said first weld portion, said first support clip and said second support clip being structured and arranged for supporting first press seal of an arc tube and a first end of a shroud, and an opposite second press seal of said arc tube and an opposite second end of said shroud, respectively, said first and second weld portions being located on the same side of said plane, said mounting member further including an elongated second member structured and arranged for mounting within an arc discharge lamp and having a second length, said second length extending in said plane and being substantially parallel to said first length and having the same linear extension as said first length, said first support clip being further welded to said second length at a third weld portion, and said second support clip being further welded to said second length at a fourth weld portion spaced from said third weld portion, said first, second, third and fourth weld portions being located on the same side of said plane.

8. The mounting member of claim 7 wherein said first support clip includes a first arcuate portion adjacent said first weld portion, and said second support clip includes a second arcuate portion adjacent said fourth weld portion, said first and second arcuate portions structured and arranged to encircle respective portions of an outer peripheral surface of a shroud adjacent said first end and said second end, respectively.

9. The mounting member of claim 7 wherein said arc tube is a bubble-in-the-press arc tube, said bubble-in-the-press arc tube comprising a sealed body portion, said first press seal extending away from said body portion in a first direction and said second press seal extending away from said body portion in an opposite second direction, said bubble-in-the-press arc tube including a sealed bubble portion in each of said first and second press seal, said first and second press seals each including a first wall and an opposing second wall, each second wall including a protrusion that extends in a direction towards a first wall, said first and second walls being structured and arranged to receive therebetween respective of said first and second support clips, and each bubble portion including a first portion that extends in a direction away from a respective second wall and a second portion that extends in a direction towards a respective second wall, each second portion and a respective protrusion being structured and arranged to engage respective edges of said one of said first and second support clip to hold said support clip in place between said first and second walls.

10. The mounting member of claim 9 further including an elongated second member structured and arranged for mounting within an arc discharge lamp and having a second length, said second length extending in said plane and being substantially parallel to said first length, said first support clip being further welded to said second length at a third weld portion, and said second support clip being further welded to said second length at a fourth weld portion spaced from said third weld portion, said first, second, third and fourth weld portions being located on the same side of said plane.

11. The mounting member of claim 9 wherein said bubble-in-the-press arc tube further includes a conductive first foil in said first press seal, a first electrode electrically connected to said first foil and extending into an interior of said body portion, and a first lead electrically connected to said first foil and extending out of said first press seal, and a conductive second foil in said second press seal, a second electrode electrically connected to said second foil and extending into said interior of said body portion, and a second lead electrically connected to said second foil and extending from said second foil out of said second press seal.

12. The mounting member of claim 11 wherein at least one of said first foil and said second foil includes a segment that extends into a bubble portion of one of said first press seal and said second press seal, respectively.

13. The mounting member of claim 12 wherein each second portion and respective protrusion are structured and arranged to substantially center a respective of said first and second support clips between said first and second walls of each of said first and second press seals, respectively.

14. The mounting member of claim 7 wherein said arc tube is a bubble-in-the-press arc tube.

15. An electric lamp assembly comprising a sealed light-transmissive lamp envelope enclosing an interior, a mounting member within said interior and mounted on said envelope, said mounting member including one or more support clip, a light-transmissive shroud mounted within said interior, a bubble-in-the-press arc tube extending into said shroud and being mounted to said mounting member, and an electrical energy coupling within said interior and associated with said arc tube, wherein the improvement comprises said arc tube comprising at least one press seal including a first wall and an opposing second wall, said second wall including a protrusion that extends in a direction towards said first wall, said first and second walls being structured and arranged to receive therebetween a support clip of said one or more support clip, and said bubble portion including a first portion that extends in a direction away from said second wall and a second portion that extends in a direction towards said second wall, said second portion and said protrusion being structured and arranged to engage and hold said support clip of said one or more support clip, in place between said first and second walls.

16. In an electric lamp assembly comprising a sealed light-transmissive lamp envelope enclosing an interior, a mounting member within said interior and mounted on said envelope, said mounting member comprising a first support clip and a second support clip, a light-transmissive shroud being supported between said first and second support clips, a bubble-in-the press arc tube extending into said shroud and being mounted to said first and second support clips, said arc tube having a body portion, a first press seal extending from said body portion in a first direction and a second press seal extending from said body portion in an opposite second direction, and an electrical energy coupling within said interior and associated with said arc tube, wherein the improvement comprises (a) said first and second press seals each including a first wall and an opposing second wall and a bubble portion, each second wall including a protrusion that extends in a direction towards a respective first wall, said first and second walls being structured and arranged to receive therebetween a respective support clip of said first and second support clip, each bubble portion including a first portion that extends in a direction away from a respective second wall and a second portion that extends in a direction towards said respective second wall, each second portion and respective protrusion being structured and arranged to engage and hold a respective support clip in place between respective first and second walls, and (b) said mounting member comprising at least an elongated first member having a first length, said first length extending in a plane, said first support clip welded to said first length at a first weld portion, and said second support clip welded to said second length at a second weld portion spaced from said first weld portion, said first and second weld portions being located on the same side of said plane.

17. The electric lamp assembly of claim 16 wherein said bubble-in-the-press arc tube includes a conductive first foil in said first press seal, a first electrode electrically connected to said first foil and extending into an interior of said body portion, and a first lead electrically connected to said first foil and extending out of said first press seal, and a conductive second foil in said second press seal, a second electrode electrically connected to said second foil and extending into said interior of said body portion, and a second lead electrically connected to said second foil and extending out of said second press seal.

18. The electric lamp assembly of claim 17 wherein at least one of said first foil and said second foil includes a segment that extends into a bubble portion of one of said first press seal and said second press seal, respectively.

19. The electric lamp assembly of claim 18 wherein each second portion and respective protrusion are structured and arranged to substantially center a support clip of said first and second support clips between said first and second walls.

20. The electric lamp assembly of claim 16 wherein said mounting member includes an elongated second member having a second length, said second length extending in said plane and being substantially parallel to said first length, said first and second support clips being further welded to said second length at a third weld portion, and a fourth weld portion spaced from said third weld portion, respectively, said first, second, third and fourth weld portions being located on the same side of said plane.

21. The electric lamp assembly of claim 20 wherein said first support clip includes a first arcuate portion adjacent said first weld portion and said second support clip includes a second arcuate portion adjacent said fourth weld portion, said first and second arcuate portions engaging and encircling respective portions of an outer peripheral surface of said shroud.

* * * * *